US005690601A

United States Patent [19]

Cummings et al.

[11] Patent Number: 5,690,601

[45] Date of Patent: Nov. 25, 1997

[54] METHOD AND APPARATUS FOR SLITTING AND SCORING CORRUGATED PAPERBOARD SHEETS FOR FOLDING

[75] Inventors: James A. Cummings; Arthur P. Burkart, both of Phillips, Wis.

[73] Assignee: Marquip, Inc., Phillips, Wis.

[21] Appl. No.: 660,858

[22] Filed: Jun. 10, 1996

[51] Int. Cl.[6] ..... B31D 5/04; B31F 1/10

[52] U.S. Cl. ..... 493/340; 83/407; 83/886; 83/884; 493/399; 493/402

[58] Field of Search ..... 493/396–402, 493/354, 355; 83/407, 425.3, 884, 886, 887, 508.3, 875

[56] References Cited

U.S. PATENT DOCUMENTS

| | | | |
|---|---|---|---|
| 1,129,481 | 2/1915 | Goress | 493/354 |
| 1,605,518 | 11/1926 | Davis . | |
| 2,185,675 | 1/1940 | Mitchell et al. | 493/397 |
| 5,002,524 | 3/1991 | Mills . | |
| 5,466,211 | 11/1995 | Komarek et al. | 493/399 X |

*Primary Examiner*—Jack W. Lavinder
*Assistant Examiner*—Anthony Ojini
*Attorney, Agent, or Firm*—Andrus, Sceales, Starke & Sawall

[57] ABSTRACT

Corrugated paperboard box blanks are formed with corner fold lines defined by a colinear slit and score. The score deflects one slit edge of the liner out of the plane of the blank such that, when a subsequent lateral fold is made on the line, one slit edge tucks consistently under the other along the full length of the fold line. The resultant box blanks fold more squarely than prior art folded boxes with no significant loss in the compressive strength of the box.

3 Claims, 3 Drawing Sheets

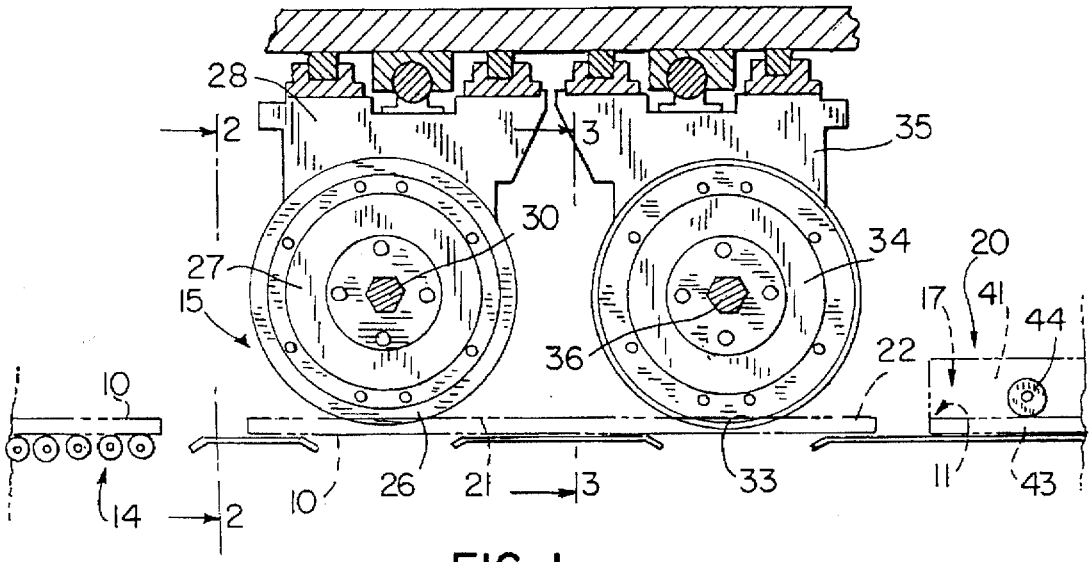
FIG. 1
FIG. 2
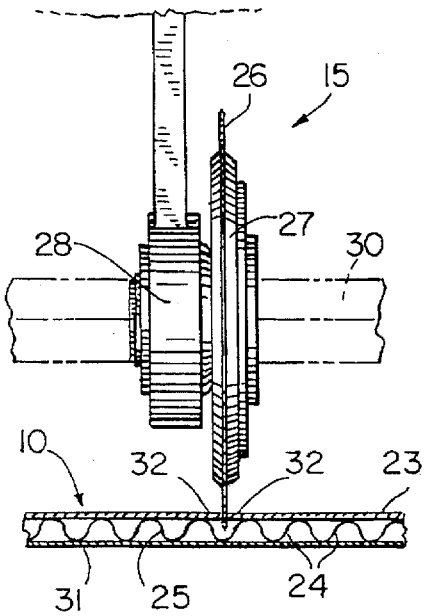
FIG. 3
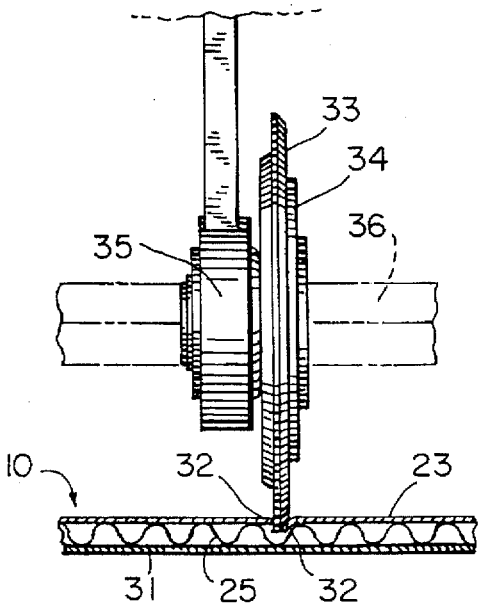

FIG. 4
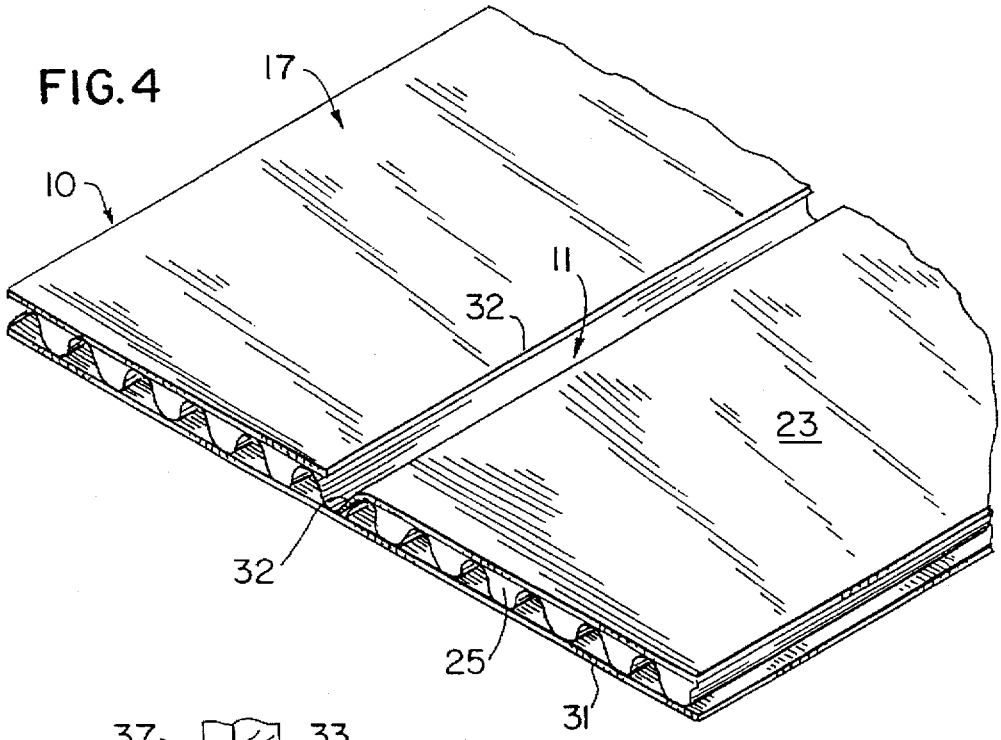
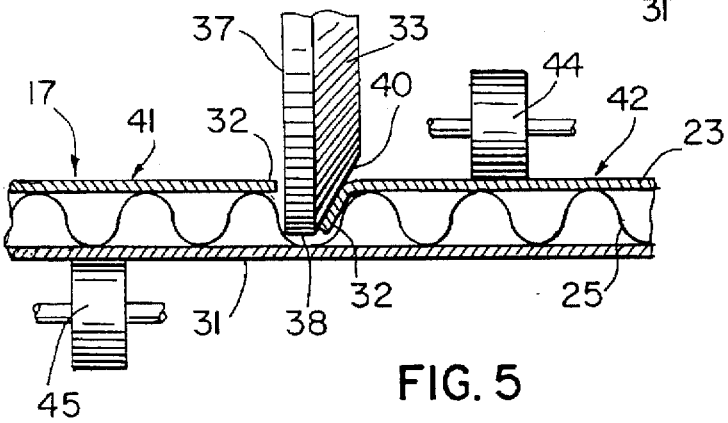
FIG. 5
FIG. 6
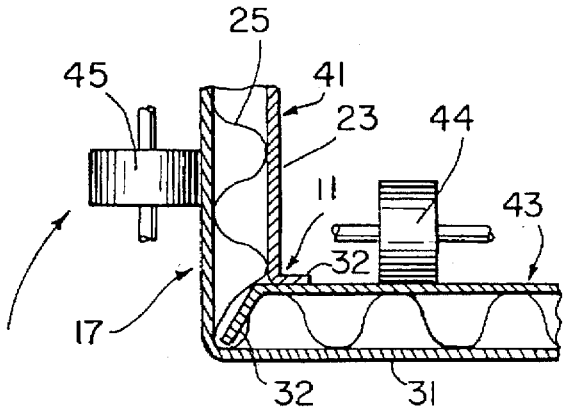

METHOD AND APPARATUS FOR SLITTING AND SCORING CORRUGATED PAPERBOARD SHEETS FOR FOLDING

BACKGROUND OF THE INVENTION

The present invention pertains to an apparatus and related method for providing the fold lines in corrugated paperboard sheets and, more particularly, to an apparatus and method for more accurately forming the fold lines in a direction parallel to the flutes of the corrugated medium which fold lines define the corners of a corrugated box.

Sheets of corrugated paperboard which are converted into corrugated paperboard boxes are typically run through a series of slitting, scoring and slotting operations and subsequently folded and glued to provide a flattened container or knocked down box (KDB). Initial slitting and scoring operations are typically performed on the corrugated paperboard web in the corrugator and in a direction perpendicular to the flutes of the corrugated medium. These preliminary slits typically define the lateral edges of the box blanks. The score lines, formed parallel to these longitudinal slits, typically define the fold lines for the closure flaps on the bottom and top of the boxes to be eventually formed from sheets cut from the web. The prescored sheets are taken from the corrugator, reoriented 90° about a vertical axis, and delivered serially into a folding and gluing apparatus in which parallel fold lines (perpendicular to the prescores) are formed which define what will eventually be the corners of the box, and the sheet is folded laterally on two of the corner fold lines and glued on one overlapping edge. The folding and gluing apparatus typically includes an upstream flexographic printer as well as slotting tools aligned with the corner scoring tools to provide the typical clearance for the flaps forming the box bottom and top. The entire apparatus is commonly referred to as a flexo-folder-gluer or simply a flexo.

It is well known in the corrugated paperboard box industry that dimensional control of the finished knocked down boxes and, significantly, the strength thereof depends on the ability to provide straight, square folds. However, notwithstanding long time attempts to develop automatic folding apparatus to attain these goals, corrugated paperboard sheets are still often folded so that the resultant glued knocked down boxes are out of square. The out of squareness is commonly referred to in the industry as fishtail. Fishtail is not only cosmetically unacceptable, but also may affect further downstream feeding and processing, and may adversely affect the ultimate strength of the box.

The corner fold lines formed in the flexo are parallel to the flutes of the corrugated paperboard medium. As indicated, the folds are defined by score lines formed by conventional rotary scoring tools in the scoring station of the flexo. It has been found that in the 180° fold subsequently made on the scored fold line, the paperboard liner on the inside of the fold along its length may either tuck into the fold or pop out of the fold on an unpredictable and random basis. This unpredictable positioning of the liner, in turn, appears to depend upon the position of the score line with respect to the flute tips running in parallel with the scorer. Often times, there is a lack of absolute parallelism along the length of the fold and the resultant unpredictably varying fold line is sometimes referred to as a rolling score. Further, it has been found that, in actual top to bottom compression (TBC) tests, the failure of conventionally scored boxes tends to be uniformly traceable to that part of the fold line where the inside liner has popped out of the fold rather than being tucked into it.

U.S. Pat. 1,605,518 discloses an apparatus for slitting the liner of a box blank, instead of scoring the same, to provide a fold line. It has been found, however, that merely slitting the liner does not by itself assure subsequent uniform and predictable folding on the slit line. This is because the adjacent slit edges of the inside liner may still engage one another during folding such that the slit edges may progress along the fold from one slit edge overlying the other to that same edge underlying the other. The result is much the same problem as with the conventional scored fold line. It is also known to precrush or prescore the length of a paperboard blank where the slots are subsequently cut in the slotting portion of a flexo. Such a device is shown in U.S. Pat. No. 5,002,524, but the precrushing or prescoring is done for the totally unrelated purpose of removing air from between the corrugations prior to slotting. Furthermore, the rotary precrushing and slotting tools are placed in adjacent circumferentially displaced locations on the same tool head.

SUMMARY OF THE INVENTION

In accordance with the invention disclosed and claimed herein, accurate and consistent folded corrugated paperboard box corners are provided by initially slitting one liner of the corrugated sheet defining a fold line, followed by scoring at least one of the liner edges defining the slit to displace the slit relative to the other. The subsequent lateral folding operation consistently allows one slit edge to override the other, resulting in uniformly square corners of strength comparable to those with scored fold lines.

The method of the present invention comprises the steps of aligning a slitting tool and a scoring tool on a line generally parallel to the flutes of a paperboard sheet; orienting the sheet for movement relative to the tools on that line; and, positioning the tools to sequentially provide a colinear slit and a score in one liner to define the fold line. In accordance with the preferred embodiment, the tools are positioned for slitting the liner prior to scoring. The scoring step preferably comprises positioning the scoring tool to engage one slit edge of the liner, and scoring that slit edge to displace it toward the unslit liner on the opposite face of the sheet. Alternately, the scoring step may comprise providing the scoring tool with an asymmetric scoring edge, and scoring the slit liner to vertically displace one slit edge more than the adjacent slit edge.

The presently preferred method includes the steps of slitting one liner in a direction parallel to the flutes to provide adjacent slit edges, scoring the liner along the slit edges to displace one slit edge inwardly of the sheet, and folding the sheet on the slit with the slit edges on the inside of the fold. More preferably, the scoring step comprises displacing only one of the adjacent slit edges.

The folding step preferably includes maintaining a first portion of the sheet on one side of the slit in a generally horizontal plane, folding a second portion of the sheet on the other side of the slit over the first portion, and causing the slit edges of said portions to overlap during folding along the full length of the fold. During folding, the slit edge of the second portion preferably overlaps the slit edge of the first portion.

The apparatus of the present invention comprises a slitting and scoring station positioned to receive sheets fed serially therethrough, a feeder serially directing the sheets into the slitting and scoring station in a direction parallel to the flutes of the corrugated medium, a slitting tool in the slitting and scoring station positioned to slit one liner of each sheet on a fold line, a scoring tool in the slitting and scoring station positioned downstream of the slitting tool and aligned therewith to score the slit liner, and a folding station downstream of the slitting and scoring station which includes an apparatus for folding a portion of the sheet on one side of the slit over the other portion of the sheet adjacent the slit with the slit inside the fold. The scoring tool is preferably positioned to displace only one of the slit edges out of the plane of the liner and, particularly, to displace the edge in a direction perpendicular to the plane of the liner by an amount more than the displacement of the adjacent slit edge.

BRIEF DESCRIPTION OF THE DRAWINGS

FIG. 1 is a generally schematic side elevation of the slitting and scoring section of a folder-gluer receiving corrugated sheets from an upstream source and supplying them to the downstream folding section.

FIG. 2 is an enlarged vertical section taken on line 2—2 of FIG. 1.

FIG. 3 is an enlarged vertical section taken on line 3—3 of FIG. 1.

FIG. 4 is a perspective view of a corrugated paperboard sheet after passage through the slitting and scoring section of FIG. 1 and prior to folding.

FIG. 5 is an enlarged detail portion of FIG. 3.

FIG. 6 is a detailed view similar to FIG. 5 showing the corrugated sheet in a partially folded position on the slit and scored line formed in accordance with the method and apparatus of the present invention.

DETAILED DESCRIPTION OF THE PREFERRED EMBODIMENTS

Figure 7:
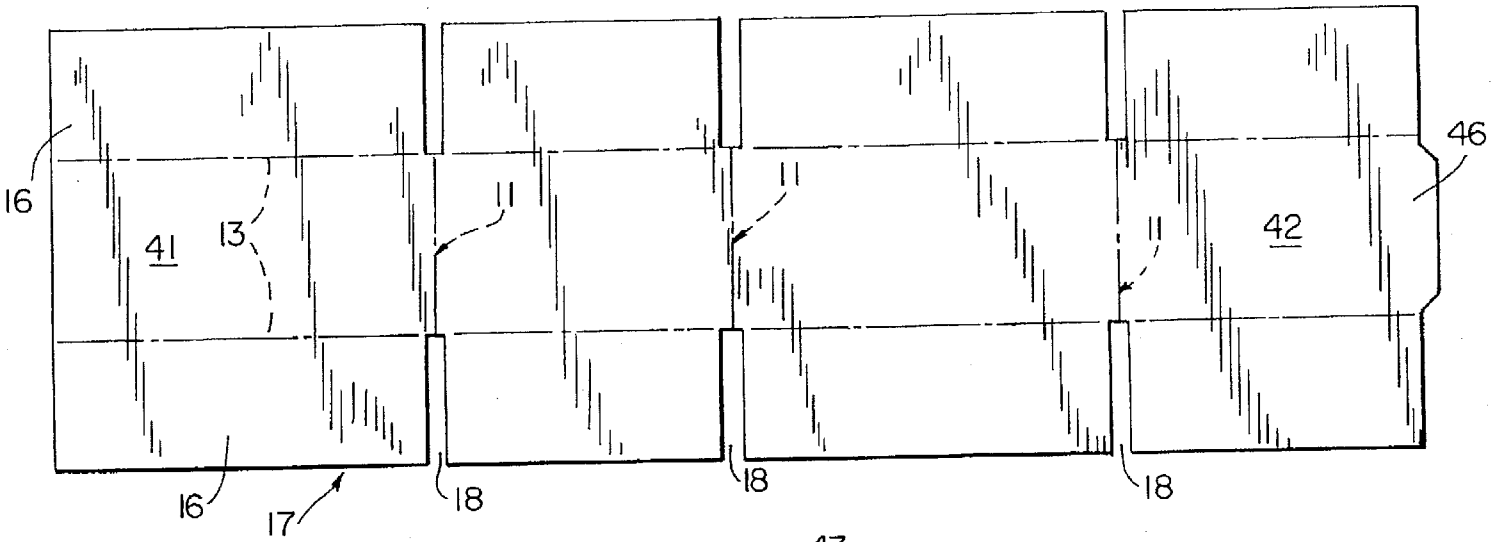
FIG. 7 is a top plan view of a completed box blank, after formation of the fold lines, but prior to folding.

In FIG. 1, there is shown in a generally schematic fashion the section of a flexo-folder-gluer in which the fold lines are formed in a generally rectangular corrugated paperboard sheet 10, the fold lines eventually defining the corners of a box formed in the downstream folding and gluing sections. Each paperboard sheet 10 is typically provided with three parallel fold lines 11, two of which define the outside corners of the folded and glued knocked down box 12 shown in FIG. 8. FIG. 7 shows a typical paperboard sheet 10 after it is slit and scored in accordance with the present invention and slotted to form a box blank, but before folding. The paperboard sheets 10 are fed serially, in the direction shown by the arrows in FIGS. 1 and 7, from an upstream conveying device 14 which may also include a flexographic printer, all as well known in the art. The incoming sheets 10 have already been provided with lateral score lines 13 formed in the corrugator. These lateral score lines define the fold lines for the box flaps 16, the side edges of which are defined by the slots 18 formed in the slotting portion (not shown) of the flexo. Thus, the completed flat box blank 17 of FIG. 7 comprises the workpiece which enters the downstream folding section 20 depicted schematically in FIG. 1.

The corner fold lines 11 on the incoming paperboard sheets 10 are formed in the apparatus and in accordance with the method of the present invention by providing a slit 21 followed immediately by a colinear and coextensive score 22 to define the fold line 11 as best shown in FIG. 4. Referring also to FIG. 2, the initial slit 21 is formed in the upper liner 23 of the paperboard sheet. The sheet is oriented and processed through the flexo in a direction parallel to the flutes 24 formed by the corrugated medium 25. Although the slit may be provided by any type of appropriate slitting tool which provides a narrow clean slit in the liner 23, it is presently preferred to use a thin rotary driven slitting blade 26 of a type shown, for example, in U.S. Pat. No. 5,090,281. The blade 26 is mounted on a tool holder 27 which in turn is rotatably mounted on a laterally positionable tool head 28. Rotary motion is provided for the slitting blade 26 by a drive shaft 30, along which the blade holder and tool head may move laterally for repositioning, all in a manner described in detail in the above identified patent.

The depth of the slit must be shallow enough to avoid slitting the bottom liner 31. However, depending on the lateral positioning of the flutes 24 in the sheet, the slitting blade 26 may cut into and slit one of the flutes. This has not been found to affect the quality or strength of the subsequent folded box.

The slitting blade 26 is preferably very thin, in the range of 0.030 to 0.040 inch (0.8 to 1.0 mm). The resultant narrow slit 21 in the upper liner 23 is defined by adjacent closely spaced slit edges 32. As the paperboard sheet 10 moves through the slitting and scoring station 15, the slit 21 is engaged by a rotary scoring tool 33, as also shown in FIG. 3. The scoring tool 33 is attached to a tool holder 34 which, in turn, is rotatably mounted on a tool head 35 and is driven by a drive shaft 36 in the same manner as the slitting blade previously described. The scoring tool 33 preferably has an edge profile, as best seen in FIG. 5, which is defined by a flat vertical side face 37, an annular nose 38 and a tapered opposite side face 40. The scoring tool is positioned on its tool head 35 to place the flat vertical side face 37 of the tool so that it just clears one slit edge 32 of the slit 21. Thus, the scoring tool preferably only engages the other slit edge 32 and bends that edge downwardly into the space defined by the corrugated medium 25, and permanently deforms the slit edge so that it remains deflected downwardly, as shown in FIG. 4.

The paperboard sheet, which normally has been previously run through an upstream slotter (not shown) to create the slots 18, exits the slitting and scoring station 15 in the form of the box blank 17 shown in FIG. 7. The blank proceeds directly into the folding section 20 where the laterally outside large and small side panels 41 and 42 are each folded 180° about identically formed slits 21 provided in the manner just described. In FIG. 6, a portion of the box blank 17 is shown with the side panel 41 half way through its fold over the stationary center section 43 of the blank. As shown in FIG. 6, the unscored slit edge 32 overrides the deformed and vertically displaced scored slit edge 32 as the corner fold is created. The center section 43 may be positioned in the folding section 20 with a series of holddown rollers 44 (one of which is schematically shown in FIG. 6), while a series of pivotal folding rollers 45 folds the side panel 41 thereover. Schematic representation of folding in FIG. 6 is by way of example only, it being understood that the folding sections of flexos utilize a wide variety of folding mechanisms.

Figure 8:
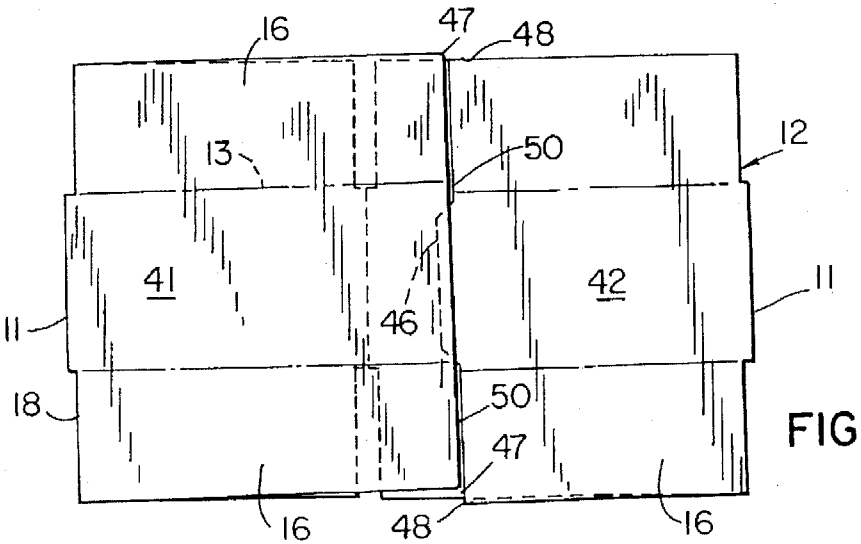
FIG. 8 is a top plan view of a folded and glued regular slotted container showing the nature of defects addressed and cured by the method and apparatus of the present invention.

In the upstream portion of the folding section 20, before the side panels 41 and 42 are actually folded on the slit fold lines 11, a glue tab 46 formed integrally on the edge of the side panel 42 is coated with a layer of a suitable adhesive. As the subsequent full 180° folds of the side panels 41 and 42 are completed, the former overlies and engages the glue tab of the latter to complete formation of the conventional flattened box blank or knocked down box (KDB). Ideally, the folded side panels 41 and 42 align perfectly with the center section 43 to provide a completely square KDB. Practically, however, because of the difficulties described above in forming accurate and consistent fold lines 11, in addition to the inherent difficulty in providing on-the-fly folds in moving box blanks, KDBs inherently exhibit some amount of fishtail. As shown in FIG. 8, the fishtail may be characterized by an out of squareness of one side panel 42 in the upstream direction (positive fishtail 47) and/or out of squareness of the other side panel 41 in the downstream direction (negative fishtail 48). Either or both fishtail deviations also affect the gap 50 between the glued side panels. Fishtail and gap deviations are known to interfere with downstream processing, subsequent erection of the boxes, and the strength of the containers, such as top to bottom compression (TBC). Fold lines created by the colinear slit 21 and score 22 in accordance with the present invention have been found to reduce fish tail and gap deviation considerably while surprisingly maintaining TBC values, as compared to boxes made from blanks with fold lines provided by conventional scoring only. In a preliminary test, 50 paperboard sheets with lateral flap score lines 13 were collected from the same corrugator run. Two randomly selected samples of 25 sheets each were formed into identical box blanks 17, except one sample was provided with conventional scores only for the fold lines 11, while the other sample blanks were provided with the colinear slit 21/score 22 fold lines in accordance with the present invention. The resultant folded and glued box blanks showed a fishtail reduction in the slit-scored blanks compared to the conventionally scored blanks as follows:

On the long panel 41: from 0.21 inch (5.3 mm) for conventional blanks, to 0.0271 inch (1.8 mm) for slit-scored blanks, On the short panel 42: from 0.275 inch (7.0 mm) for conventional blanks, to 0.083 inch (2.1 mm) for slit-scored blanks.

Boxes were erected from the blanks of both samples, the flaps secured in accordance with TAPPI T-804 test standards, and tested for TBC in a conventional box compression tester. For the conventionally made boxes with scored corner fold lines only, the average TCB was 779 lbs., with a standard deviation of 45.4 lbs. In the boxes made with fold lines in accordance with the slit-score fold lines of the present invention, the average TCB was 771 lbs., with a standard deviation of 35.6 lbs. The TBC results show an average TBC reduction of only about 1% in boxes incorporating the slit-score fold line of the present invention, but an improvement of almost 22% in the standard deviation.

Different and less complex scoring tool profiles may also be used in the practice of this invention. For example, a simple square-edged rotary scoring tool has been successfully tested. The important consideration is to assure that the scoring tool is positioned laterally with respect to the slit 21 so that the tool engages only one of the slit edges 32. However, a scoring tool 33 with the asymmetric profile described above is preferred because the tapered side face 40 provides a smoother transition for the vertically displaced slit edge 32 which is pushed into the space occupied by the corrugated medium 25.

With careful control of the scoring tool profile, it is also possible to successfully practice the subject invention by reversing the sequence of formation of the fold line 11. Thus, it is possible to provide a score followed by a slit, although control of the slit edges and ultimate fold line quality are more difficult. In this embodiment, the downstream slitting blade is preferably laterally positioned to engage the prescore at one lateral edge.

We claim:

1. A method for providing a fold line in a corrugated paperboard sheet for making a folded box blank which sheet includes a fluted medium and enclosing liners, said method comprising the steps of:

(1) aligning a slitting tool and a scoring tool on a line generally parallel to the flutes of the paperboard sheet;

(2) orienting the sheet for movement on said line relative to said tools; and, (3) positioning the tools to sequentially provide a colinear and coextensive slit and score in one liner to define the fold line by slitting the liner prior to scoring;

(4) positioning said scoring tool to engage one slit edge of the liner; and, (5) scoring only said one slit edge to displace the same toward the unslit liner.

2. A method for providing a fold line in a corrugated paperboard sheet for making a folded box blank, which sheet includes a fluted medium and enclosing liners, said method comprising the steps of:

(1) slitting one liner in a direction parallel to the flutes to provide adjacent slit edges;

(2) scoring said liner along only one of said slit edges to displace said one slit edge inwardly of the other slit edge; and, (3) folding the sheet on the slit to place the slit edges on the inside on the fold and to cause the other slit edge to override the scored slit edge.

3. An apparatus for folding corrugated paperboard sheets, each of which sheets includes a fluted medium and opposite enclosing liners, said sheets being folded along parallel spaced fold lines which fold lines extend in a direction parallel to the flutes, said apparatus comprising:

a slitting and scoring station positioned to receive sheets fed serially therethrough;

a feeder serially directing the sheets into said slitting and scoring station in a direction parallel to the flutes;

a slitting tool in said slitting and scoring station positioned to slit one liner of each sheet on a fold line;

a scoring tool in said slitting and scoring station positioned downstream of said slitting tool and aligned therewith to score and displace only one edge of the slit liner inwardly of the plane of the liner; and, a folding station downstream of said slitting and scoring station including an apparatus for folding a portion of the sheet on one side of the slit over the other portion of the sheet adjacent the slit with the slit inside the fold and the unscored slit edge over the scored slit edge.

* * * * *